US010816305B1

(12) United States Patent
Beavers et al.

(10) Patent No.: US 10,816,305 B1
(45) Date of Patent: Oct. 27, 2020

(54) FIREARM HARNESSES

(71) Applicants: Steven Brett Beavers, Nashville, TN (US); Richard Arlin Beavers, N. Richland Hills, TX (US)

(72) Inventors: Steven Brett Beavers, Nashville, TN (US); Richard Arlin Beavers, N. Richland Hills, TX (US)

( * ) Notice: Subject to any disclaimer, the term of this patent is extended or adjusted under 35 U.S.C. 154(b) by 40 days.

(21) Appl. No.: 16/360,161

(22) Filed: Mar. 21, 2019

(51) Int. Cl.
*F41C 33/00* (2006.01)

(52) U.S. Cl.
CPC ..... *F41C 33/007* (2013.01); *F41C 33/002* (2013.01)

(58) Field of Classification Search
CPC ..... F41C 33/002; F41C 23/02; F41C 33/001; Y10S 224/913; A45F 3/14
See application file for complete search history.

(56) References Cited

U.S. PATENT DOCUMENTS

| | | | | |
|---|---|---|---|---|
| 919,301 A | | 4/1909 | Anderson | |
| 2,715,989 A | | 8/1955 | Sjodin et al. | |
| 3,098,591 A | | 7/1963 | Lerude | |
| 3,655,106 A | | 4/1972 | Wojcinski | |
| 4,331,271 A | | 5/1982 | Anderson | |
| 4,768,689 A | | 9/1988 | Davis | |
| 5,092,505 A | | 3/1992 | Olschlager | |
| 5,282,558 A | | 2/1994 | Martinez | |
| 5,370,286 A | * | 12/1994 | Newman | A45F 3/14 119/857 |
| 5,669,170 A | | 9/1997 | Norris | |
| 5,695,101 A | * | 12/1997 | Frietze | A45F 3/14 224/250 |
| 6,068,167 A | * | 5/2000 | Hopson | A45C 13/30 224/150 |
| 6,152,338 A | | 11/2000 | Smith | |
| 2012/0168470 A1 | | 7/2012 | Burton | |

* cited by examiner

*Primary Examiner* — Corey N Skurdal
(74) *Attorney, Agent, or Firm* — R. Keith Harrison

(57) ABSTRACT

Firearm harnesses suitable for securing a firearm on a firearm user may include a harness strap including a main strap segment. A rear securing assembly may be provided on the main strap segment. The rear securing assembly may include a rear securing strap segment extending from the main strap segment of the harness strap. A rear main strap segment end may terminate the rear securing strap segment. A releasable rear securing strap connector may releasably secure the rear main strap segment end of the rear securing strap segment to the main strap segment of the harness strap. A front securing assembly may be provided on the main strap segment of the harness strap in spaced-apart relationship to the rear securing assembly. The front securing assembly may include a front securing strap carried by the main strap segment. A releasable front securing strap connector may releasably secure the front securing strap between fastened and unfastened configurations.

4 Claims, 15 Drawing Sheets

FIREARM HARNESSES

FIELD

Illustrative embodiments of the disclosure generally relate to devices which are suitable for securing a firearm on a firearm user to enable hands-free carrying of the firearm. More particularly, illustrative embodiments of the disclosure relate to firearm harnesses which are simple in construction and can be fastened to a firearm with or without a sling to facilitate safe and secure, hands-free carrying of the firearm and which prevent slippage of a sling on a firearm user's shoulder as the sling supports the rifle on the firearm user.

BACKGROUND

The background description provided herein is solely for the purpose of generally presenting the context of the illustrative embodiments of the disclosure. Aspects of the background description are neither expressly nor impliedly admitted as prior art against the claimed subject matter.

Hunters may carry a rifle over one shoulder with a "sling" or strap which is attached to both ends of the rifle. However, the sling may have a tendency to slip off the shoulder if not held in place. Thus, while walking through wooded terrain, particularly up hills and through brush, the hunter may be required to maintain a grip on the sling using the hand on the side which corresponds to the shoulder over which the sling extends.

Accordingly, firearm harnesses which can be fastened to a firearm with or without a sling to facilitate safe and secure, hands-free carrying of the firearm and which prevent slippage of a sling as the sling supports the rifle on the shoulder of a firearm user may be desirable for some applications.

SUMMARY

Illustrative embodiments of the disclosure are generally directed to firearm harnesses which are simple in construction and can be fastened to a firearm with or without a sling to facilitate safe and secure, hands-free carrying of the firearm and which prevent slippage of a sling on a firearm user's shoulder as the sling supports the rifle on the firearm user. An illustrative embodiment of the firearm harnesses may include a harness strap including a main strap segment. A rear securing assembly may be provided on the main strap segment. The rear securing assembly may include a rear securing strap segment extending from the main strap segment of the harness strap. A rear main strap segment end may terminate the rear securing strap segment. A releasable rear securing strap connector may releasably secure the rear main strap segment end of the rear securing strap segment to the main strap segment of the harness strap. A front securing assembly may be provided on the main strap segment of the harness strap in spaced-apart relationship to the rear securing assembly. The front securing assembly may include a front securing strap carried by the main strap segment. A releasable front securing strap connector may releasably secure the front securing strap between fastened and unfastened configurations.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
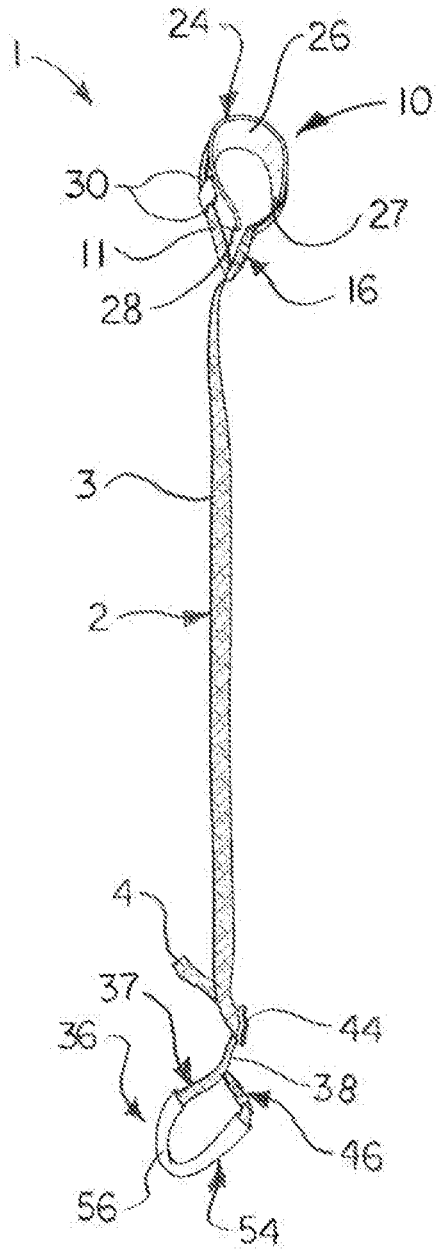
FIG. 1 is a front perspective view of an illustrative embodiment of the firearm harnesses.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. As used herein, "rear" and "front" shall refer to the respective rear (barrel) and front (stock) portions of a firearm as they relate to typical positions of components of the firearm harnesses in typical use thereof. However, it will be recognized and understood that the firearm harnesses are amenable to uses in which the components thereof labeled "front" and "rear" are located in alternative positions with respect to those portions of the firearm.

Figure 6:
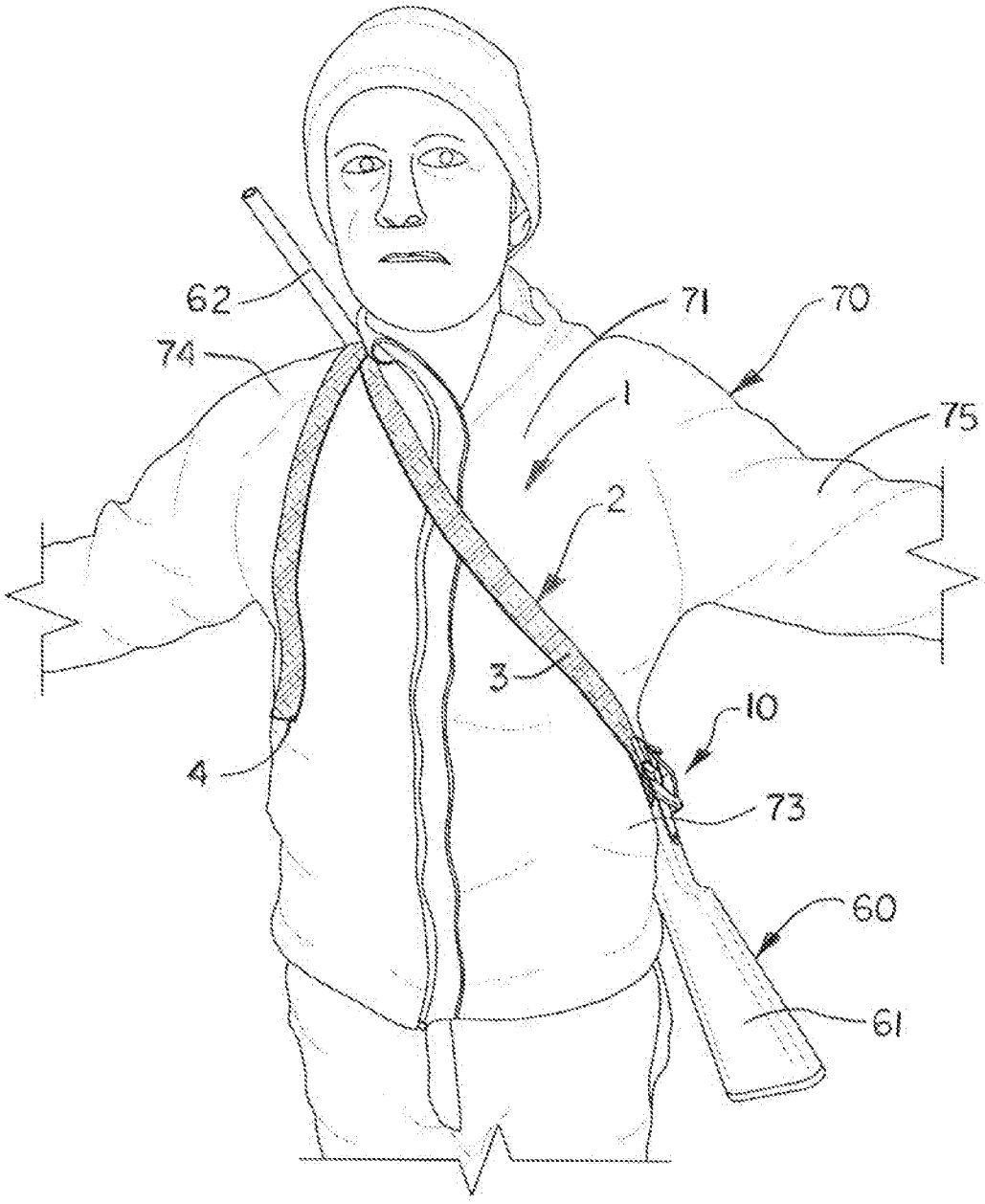
FIG. 6 is a front view of a firearm user with an illustrative firearm harness deployed in place on the firearm user and securing a firearm without a firearm sling behind the user in some applications of the firearm harnesses.
Figure 7:
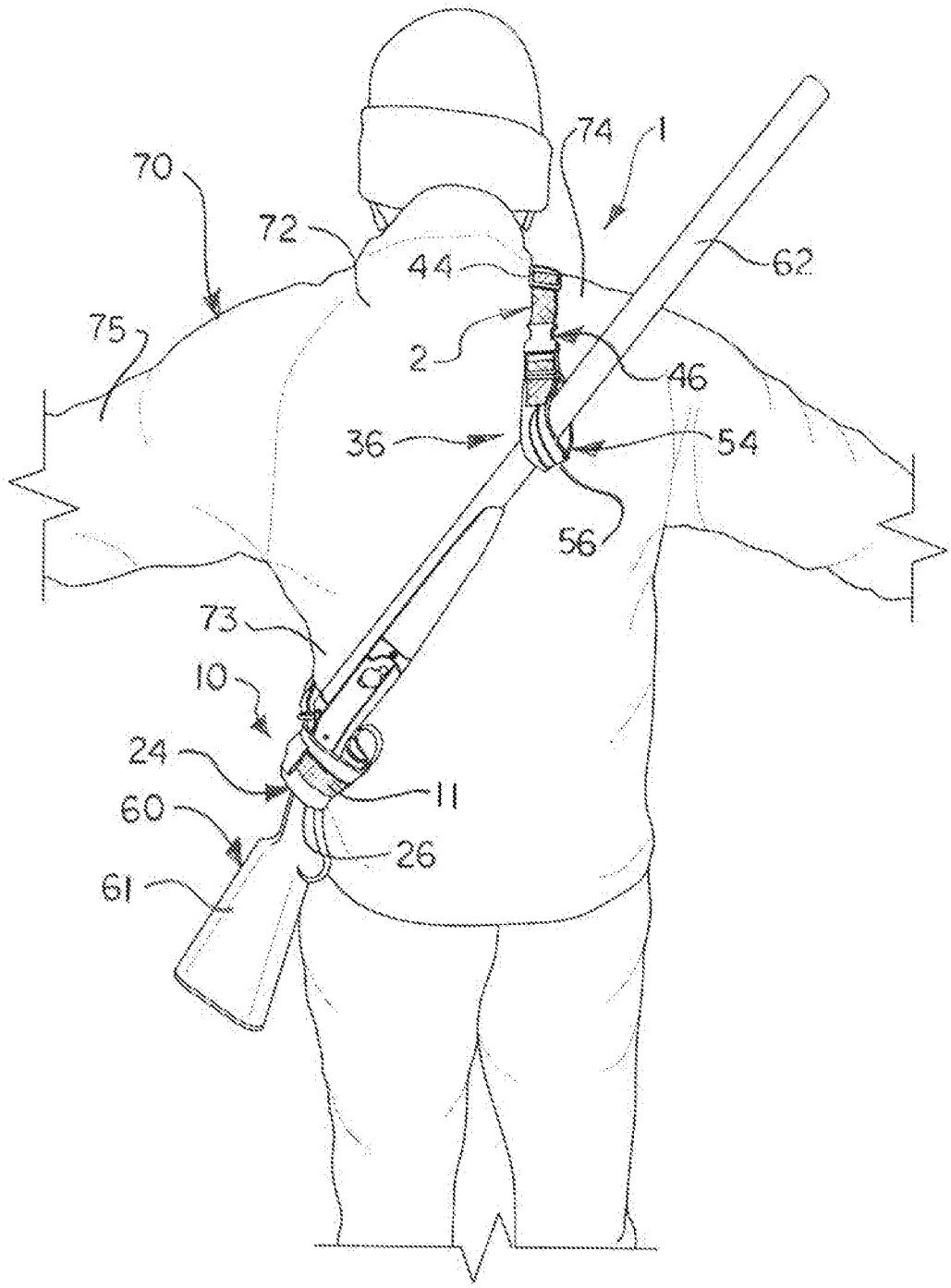
FIG. 7 is a rear view of the firearm user with the firearm harness securing the sling-less firearm to the user.
Figure 8:
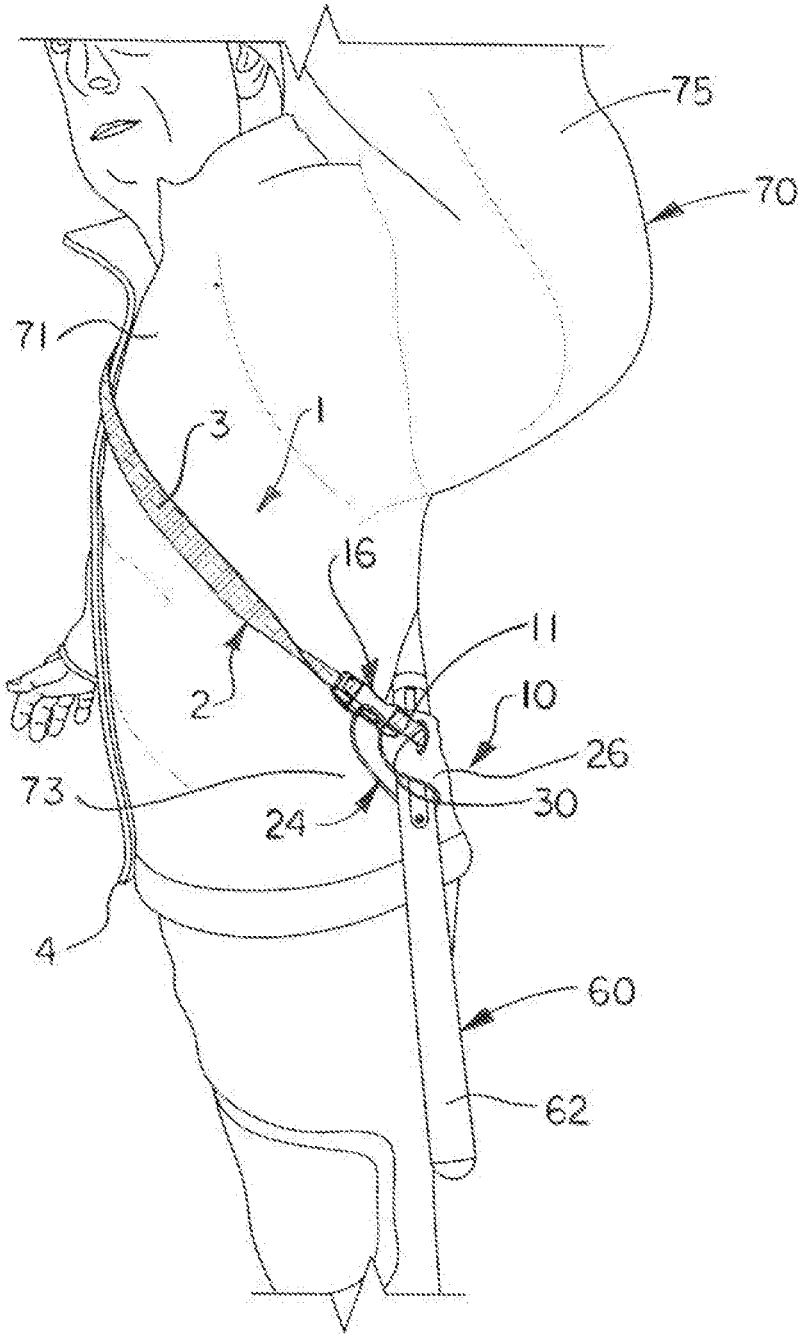
FIG. 8 is a left-side view of the firearm user with the firearm harness securing the sling-less firearm to the user.
Figure 9:
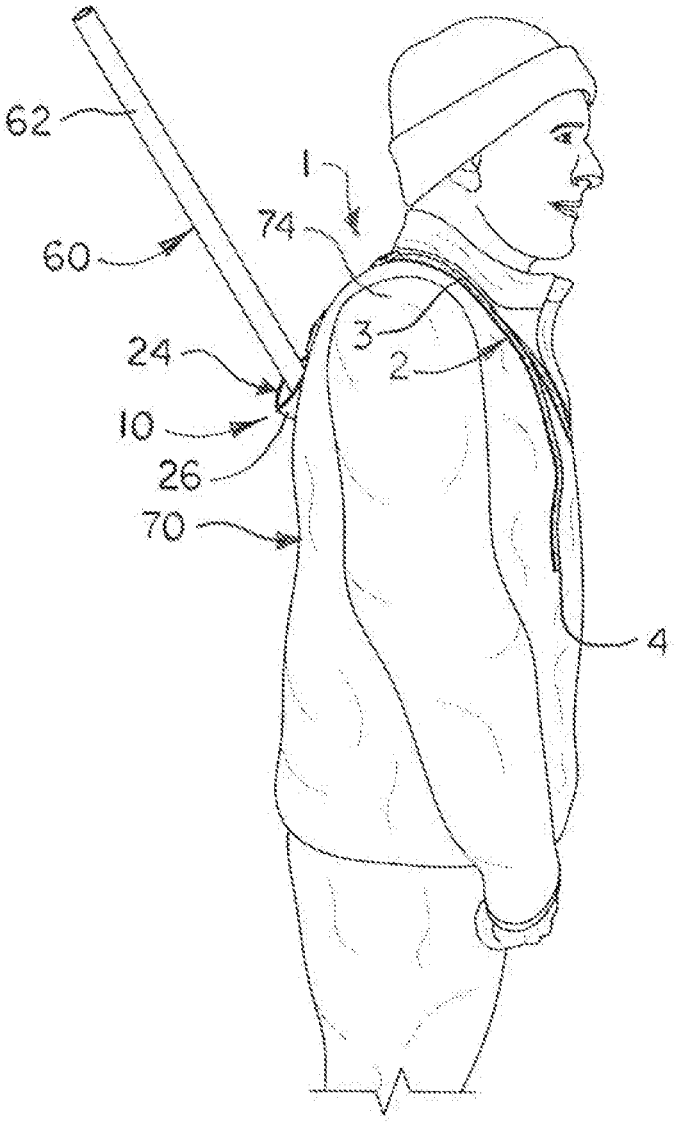
FIG. 9 is a right-side view of the firearm user with the firearm harness securing the sling-less firearm to the user.
Figure 10:
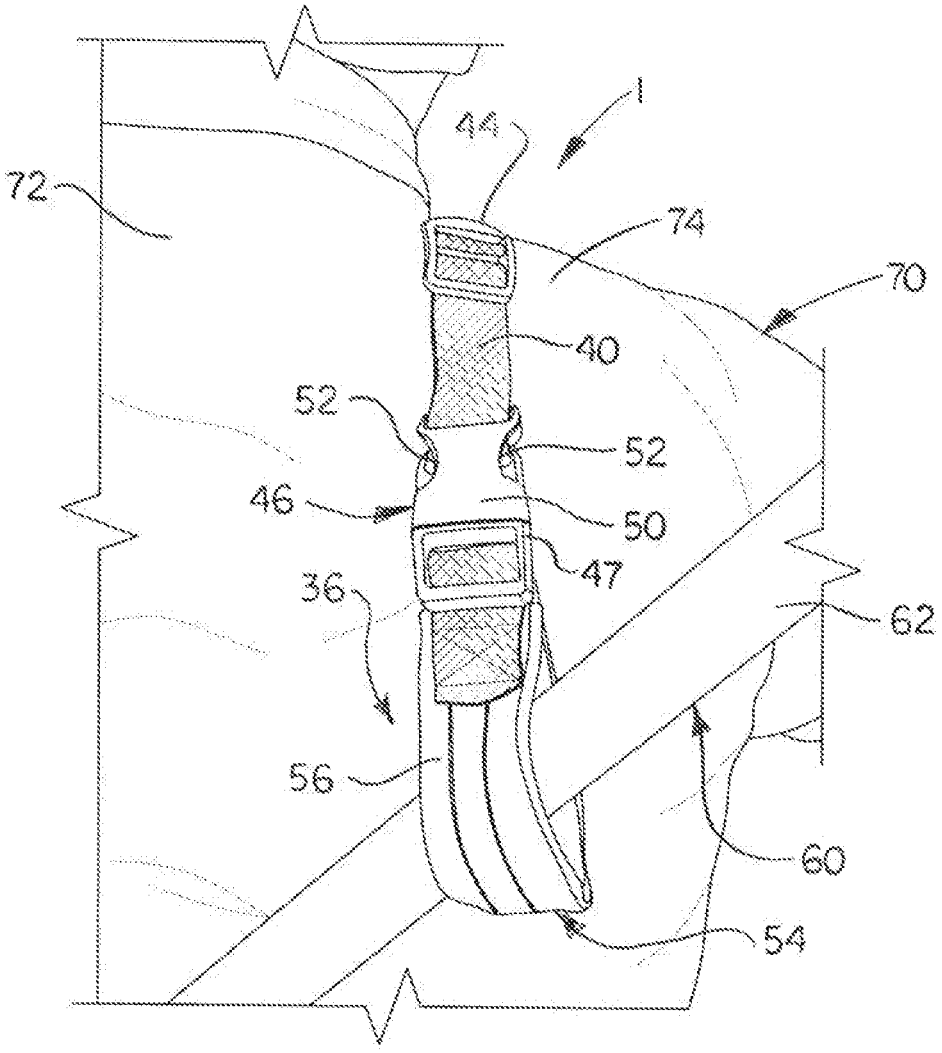
FIG. 10 is a rear perspective view of the fastened front securing assembly attached to the firearm barrel of the sling-less firearm in some applications of the firearm harnesses.
Figure 11:
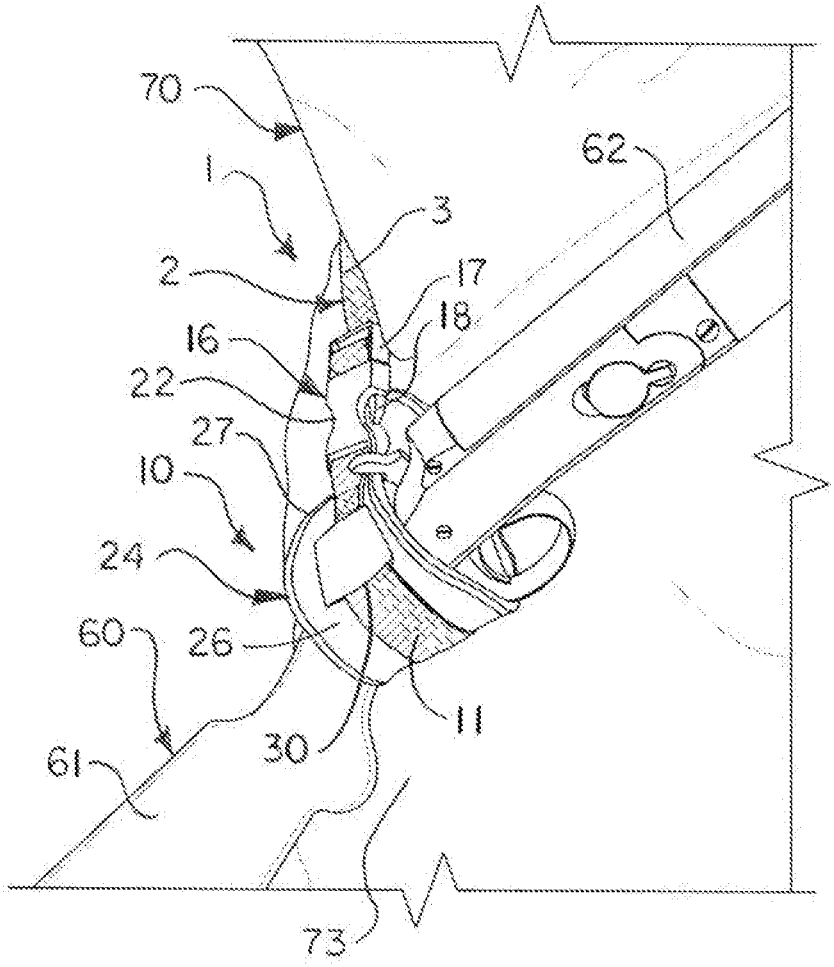
FIG. 11 is a front perspective view of the fastened rear securing assembly attached to the firearm stock of the sling-less firearm in some applications of the firearm harnesses.

Referring initially to FIGS. 6 and 7 of the drawings, an illustrative embodiment of the firearm harnesses is generally indicated by reference numeral 1. In some applications, which will be hereinafter described, the firearm harness 1 may be attached to a firearm 60 such as a long-gun firearm (rifle or shotgun) and donned by a firearm user 70 to enable the firearm user 70 to safely and securely carry the firearm 60 hands-free on even or uneven, forested or unforested ground or up a ladder leading to a deer stand or hunting blind, for example. In some applications, the firearm harness 1 may be fastened to a firearm 60 without a sling, such as a shotgun, for example and without limitation. Accordingly, the firearm harness 1 may initially be fastened at one end to the firearm stock 61 of the firearm 60. The free end of the firearm harness 1 may be extended under the arm, up and diagonally across the user's chest 71 and over the opposite shoulder 74, and then fastened to the firearm barrel 62 of the firearm 60. Accordingly, as illustrated in FIG. 7, the firearm 60 may extend diagonally across the back 72 of the firearm user 70 with the firearm barrel 62 typically aimed upwardly in an unobstructed manner as the firearm user 70 carries the firearm 60 to a selected destination or site for use. The hands of the firearm user 70 may thus remain free to carry other items and/or to grasp the rungs of a ladder leading to a deer stand or hunting blind, for example.

Figure 14:
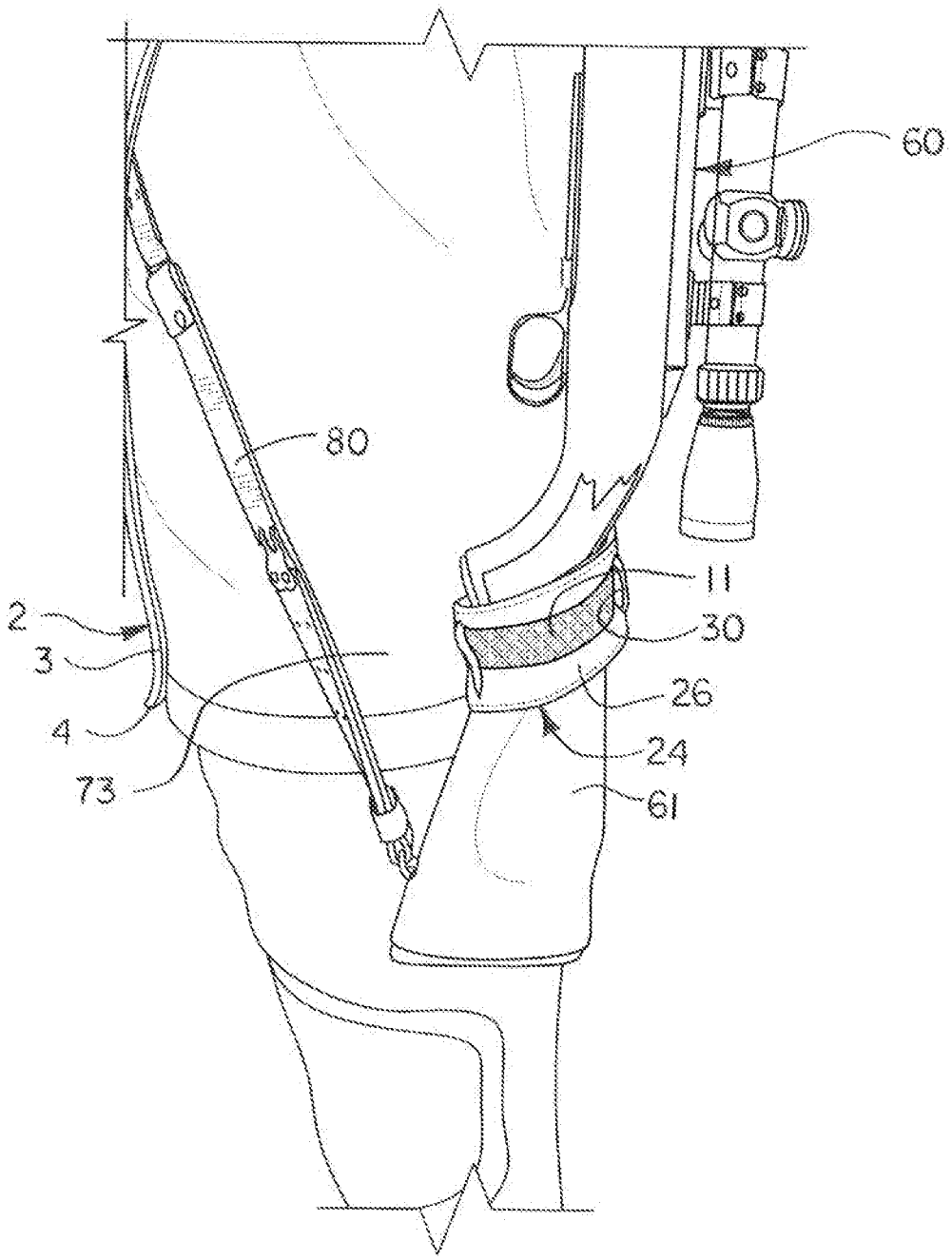
FIG. 14 is a left-side view of the firearm user with the firearm harness securing the slinged firearm to the user, more particularly illustrating the rear securing assembly fastened to the firearm stock of the firearm.
Figure 15:
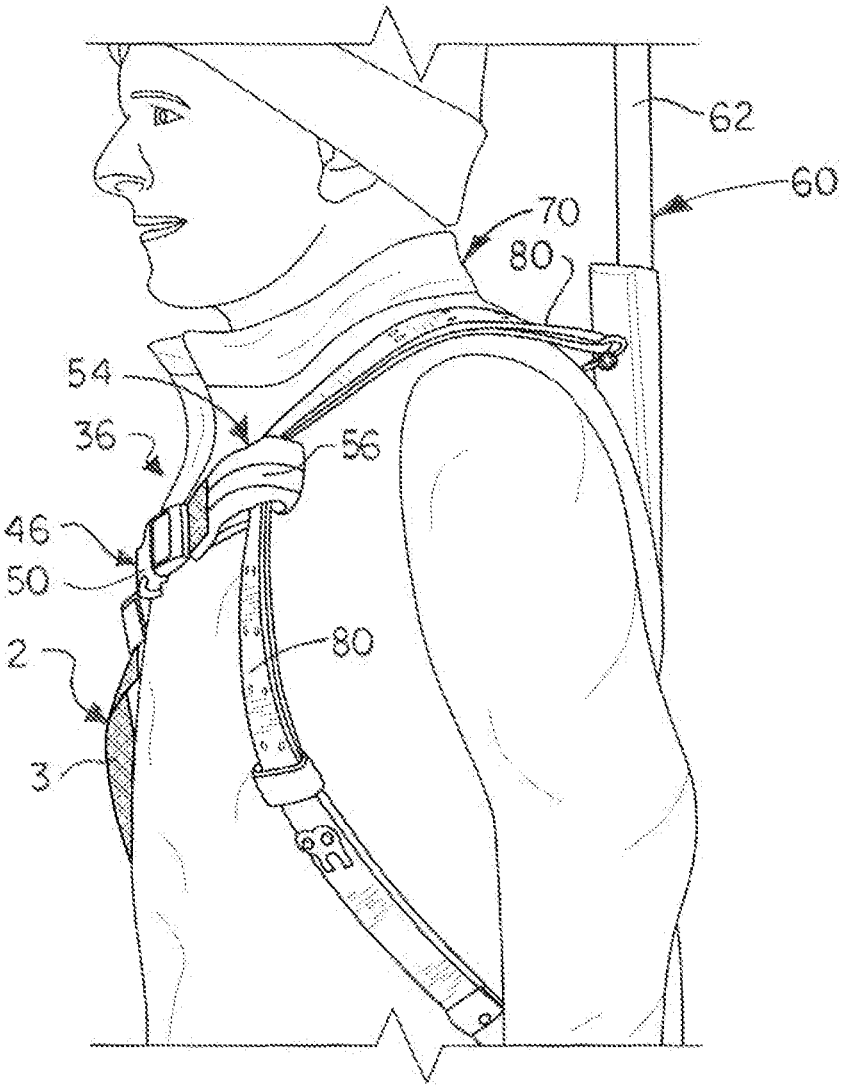
FIG. 15 is a left-side front perspective view of the firearm user with the firearm sling extending over the left shoulder of the firearm user and the front securing assembly of the firearm harness attached to the firearm sling.

Referring to FIGS. 12-15 of the drawings, in some applications, the firearm harness 1 may secure a firearm 60 fitted with a firearm sling 80 on the firearm user 70. The firearm sling 80 may have a conventional design and may have a first end attached to the firearm stock 61 and a second end attached to the firearm barrel 62 or body of the firearm 60. Accordingly, the firearm sling 80 may initially be extended over the shoulder 74 of the firearm user 70. The firearm harness 1 may be fastened at one end to the firearm stock 61 of the firearm 60. The free end of the firearm harness 1 may be extended across the back 72 and then diagonally upwardly under the arm 75 and across the chest 71 of the firearm user 70 and attached to the firearm sling 80 in front of the shoulder 74. As illustrated in FIGS. 14 and 15, the firearm 60 may extend vertically upwardly behind the hip 73 at the side of the firearm user 70 with the firearm barrel 62 typically aimed upwardly in an unobstructed manner. The firearm harness 1 may pull the firearm sling 80 toward the midline of the chest 71 of the firearm user 70 to prevent the firearm sling 80 from slipping off the firearm user's shoulder 74. Thus, the hands of the firearm user 70 may remain free as the firearm user 70 carries the firearm 60 to the selected destination or site for use.

Figure 3:
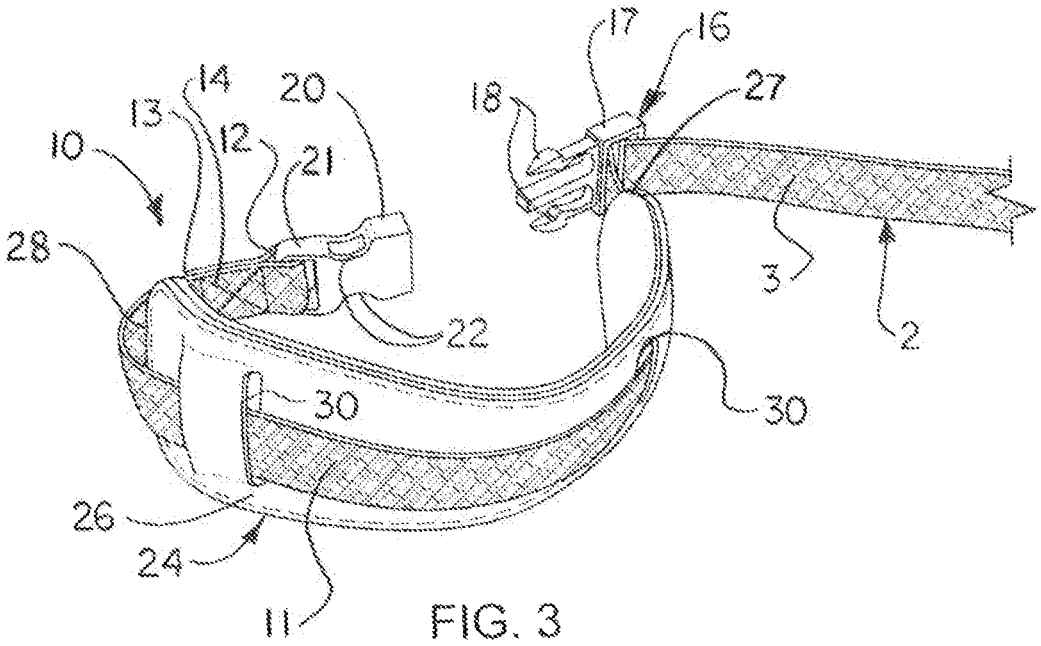
FIG. 3 is a perspective view of the rear securing assembly shown in an unfastened configuration.
Figure 4:
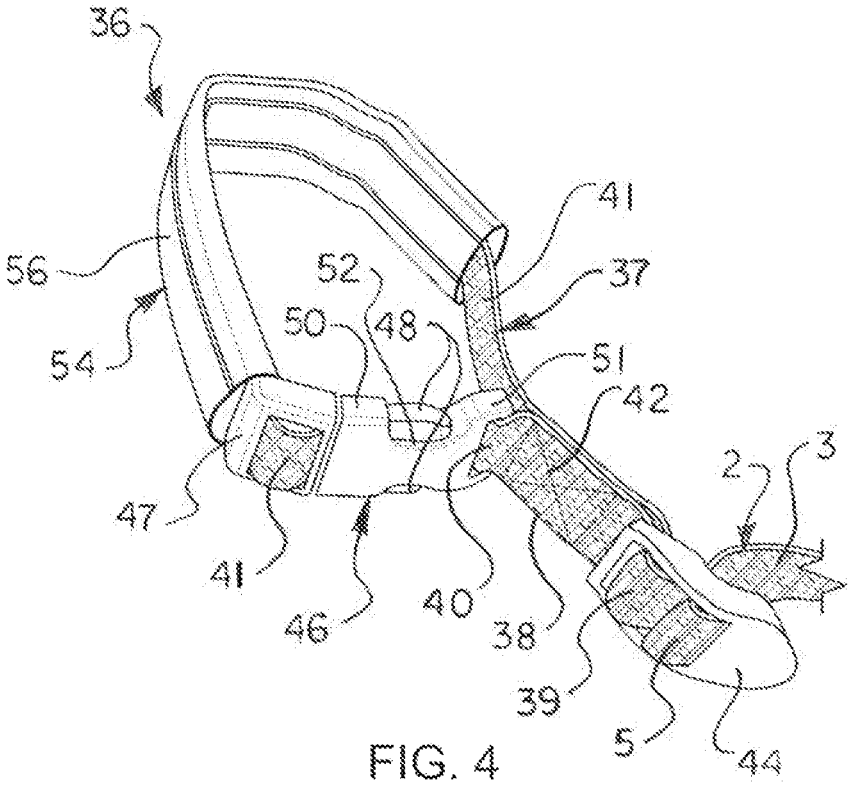
FIG. 4 is a perspective view of a typical front securing assembly of the firearm harnesses shown in a fastened configuration.
Figure 5:
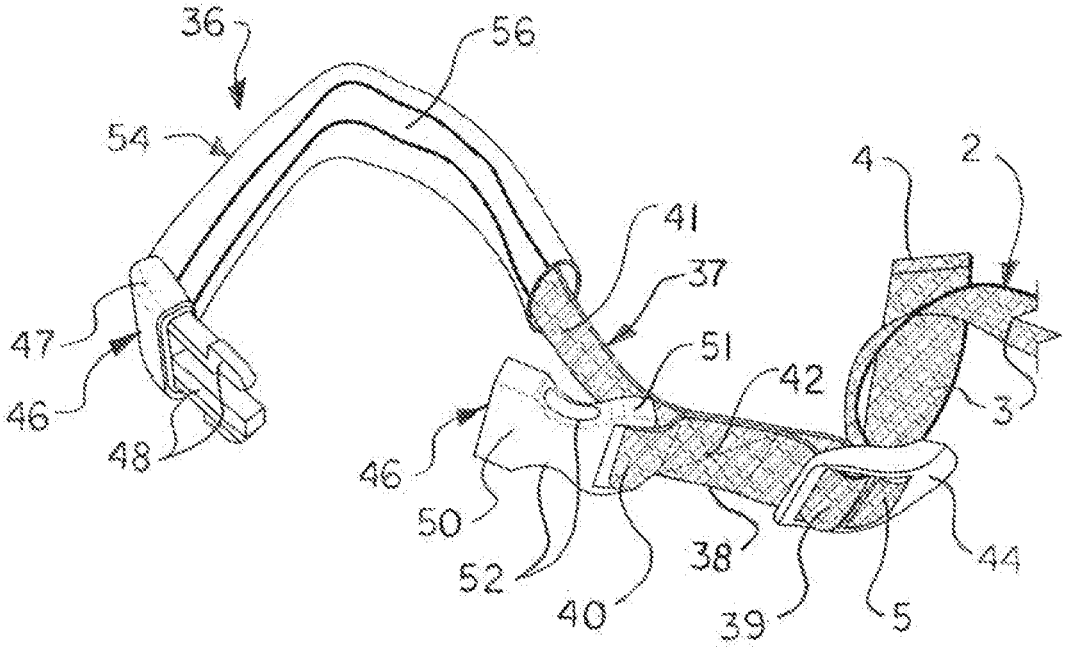
FIG. 5 is a perspective view of the front securing assembly shown in an unfastened configuration.

Referring next to FIGS. 1-5 of the drawings, the firearm harness 1 may include a harness strap 2. The harness strap 2 may include an elongated main strap segment 3 which may be fabricated of flexible material such as nylon and/or other fabric material or webbing, for example and without limitation. The main strap segment 3 may have a front main strap segment end 4. As illustrated in FIG. 5, in some embodiments, the front main strap segment end 4 of the main strap segment 3 may adjustably extend through a strap adjusting connector 44 at a main strap segment loop 5. The strap adjusting connector 44 may facilitate selective sliding adjustment in the length of the harness strap 2 typically for purposes which will be hereinafter described.

Figure 2:
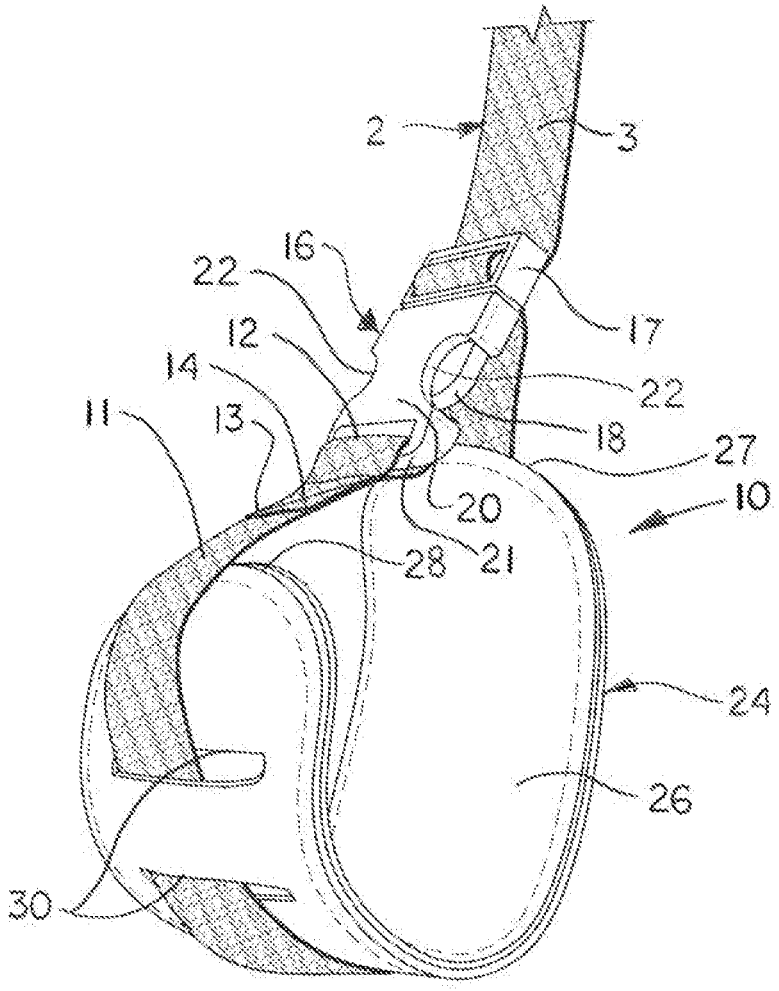
FIG. 2 is a perspective view of a typical rear securing assembly of the firearm harnesses, shown in a fastened configuration.

A rear securing assembly 10 may be provided on the main strap segment 3 of the harness strap 2. In some applications, the rear securing assembly 10 may facilitate attachment of the firearm harness 1 to the firearm stock 61 of the firearm 60, typically as will be hereinafter described. As illustrated in FIGS. 2 and 3, the rear securing assembly 10 may include a rear securing strap segment 11 which may extend from the main strap segment 3 of the harness strap 2. A rear main strap segment end 13 may terminate the rear securing strap segment 11 opposite the front main strap segment end 4 of the main strap segment 3. A releasable rear securing strap connector 16 may releasably connect the rear main strap segment end 13 of the rear securing strap segment 11 to the main strap segment 3 of the harness strap 2 in selective fastening and unfastening of the rear securing assembly 10. In some embodiments, a rear securing strap loop 12 may be formed in the rear main strap segment end 13 of the rear securing strap segment 11. The rear securing strap loop 12 may be formed by folding over and securing the rear securing strap segment 11 typically via strap stitching 14. The releasable rear securing strap connector 16 may be attached to the rear securing strap segment 11 via the rear securing strap loop 12 typically as will be hereinafter described.

In some embodiments, the releasable rear securing strap connector 16 may include a quick-disconnect connector which may have a design known by those skilled in the art. Accordingly, as further illustrated in FIGS. 2 and 3, the releasable rear securing strap connector 16 may include a rear securing strap slider 17 which may slidingly engage the main strap segment 3 of the harness strap 2 and may define a sliding boundary between the main strap segment 3 and the rear securing strap segment 11 of the harness strap 2. As illustrated in FIG. 3, a plurality of rear securing buckle tabs 18 may extend from the rear securing strap slider 17. A rear securing buckle receptacle 20 may be attached to the rear securing strap loop 12 formed in the rear main strap segment end 13 of the rear securing strap segment 11. The rear securing buckle receptacle 20 may have a strap eye 21 through which the rear securing strap loop 12 may extend. The rear securing buckle receptacle 20 may be configured to releasably receive the plurality of rear securing buckle tabs 18. A pair of tab release openings 22 may be provided in the rear securing buckle receptacle 20 to facilitate manual deformation and release of the rear securing buckle tabs 18 from the rear securing buckle receptacle 20. Alternative mechanisms or devices known by those skilled in the art, including but not limited to hook and loop fasteners, buckles, brackets, clips, clamps or combinations thereof, may be used as the releasable rear securing strap connector 16.

In some embodiments, at least one stock protector 24 may be provided on the rear securing strap segment 11 of the rear securing assembly 10. The stock protector 24 may protect the surface finish of the firearm stock 61 of the firearm 60 from being abraded or scratched by inadvertent movement of the rear securing strap segment 11 during use of the firearm harness 1. In some embodiments, the stock protector 24 may include at least one elongated, flexible stock protecting shield 26. The stock protecting shield 26 may have a proximal shield end 27 proximate the rear securing strap slider 17 and a distal shield end 28 proximate the strap eye 21 of the releasable rear securing strap connector 16. In other embodiments, the stock protector 24 may include at least one sleeve through which the rear securing strap segment 11 may extend and/or may include any other structural element or elements which may be attached to the securable strap segment 41 according to the knowledge of those skilled in the art.

The stock protecting shield 26 may be attached to the rear securing strap segment 11 according to any suitable technique which is known by those skilled in the art. In some embodiments, at least one pair of spaced-apart strap slits 30 may extend through the stock protecting shield 26. The rear securing strap segment 11 may extend through the strap slits 30. In some embodiments, the stock protecting shield 26 may include rubber, neoprene, plastic, leather, fabric and/or any other non-abrasive or minimally-abrasive material known by those skilled in the art.

A front securing assembly 36 may be provided on the main strap segment 3 of the harness strap 2 in spaced-apart relationship to the rear securing assembly 10. As illustrated in FIGS. 4 and 5, the front securing assembly 36 may include a front securing strap 37 which may be fabricated of flexible material such as nylon and/or other fabric material or webbing, for example and without limitation. The front securing strap 37 may be attached to the main strap segment 3 of the harness strap 2 typically as will be hereinafter described. A releasable front securing strap connector 46 may releasably secure the front securing strap 37 between a fastened configuration (FIG. 4) and an unfastened configuration (FIG. 5).

In some embodiments, the front securing strap 37 of the front securing assembly 36 may include a connecting strap segment 38. A proximal strap loop 39 and a distal strap loop 40 may be formed in opposite ends of the connecting strap segment 38. For example and without limitation, in some embodiments, the proximal strap loop 39 and the distal strap loop 40 may be formed by folding over and securing the connecting strap segment 38 via strap stitching 42. As used herein, "proximal" denotes a position which is closer to the longitudinal midpoint of the main strap segment 3 and "distal" denotes a position which is farther from the longitudinal midpoint of the main strap segment 3. The proximal strap loop 39 may engage the strap adjusting connector 44 on the main strap segment 3 of the harness strap 2. The releasable front securing strap connector 46 may engage the distal strap loop 40 typically as will be hereinafter described. The front securing strap 37 may further include an elongated securable strap segment 41 which may fork or extend from the connecting strap segment 38 adjacent to the distal strap loop 40.

In some embodiments, the releasable front securing strap connector 46 may include a quick-disconnect connector which may have a design known by those skilled in the art. Accordingly, a front securing strap slider 47 may terminate the securable strap segment 41 of the front securing strap 37. In some embodiments, the securable strap segment 41 may the threaded or extended through the front securing strap slider 47 and secured via strap stitching (not illustrated). A plurality of front securing buckle tabs 48 may extend from the front securing strap slider 47. A front securing buckle receptacle 50 may be provided on the distal strap loop 40 in the connecting strap segment 38 of the front securing strap 37. The front securing buckle receptacle 50 may have a strap eye 51 through which the distal strap loop 40 on the connecting strap segment 38 of the front securing strap 37 extends. The front securing buckle receptacle 50 may be configured to releasably receive the front securing buckle tabs 48 to releasably secure the front securing assembly 36 in the fastened configuration (FIG. 4). A pair of tab release openings 52 may be provided in the front securing buckle receptacle 50 to facilitate manual release of the front securing buckle tabs 58 from the front securing buckle receptacle 50, as illustrated in FIG. 5. Alternative mechanisms known by those skilled in the art, including but not limited to hook and loop fasteners, buckles, brackets, clips, clamps or combinations thereof, may be used as the releasable front securing strap connector 46.

In some embodiments, at least one barrel protector 54 may be provided on the front securing strap 37 of the front securing assembly 36. The barrel protector 54 may protect the surface finish of the firearm barrel 62 of the sling-less firearm 60 from being abraded and scratched by movement of the front securing strap 37 during use of the firearm harness 1 as illustrated in FIGS. 6-11. In some embodiments, the barrel protector 54 may include at least one barrel protecting sleeve 56 through which the securable strap segment 41 of the front securing strap 37 extends. The barrel protecting sleeve 56 may include rubber, neoprene, plastic, leather, fabric and/or any other non-abrasive or minimally-abrasive material known by those skilled in the art. In other embodiments, the barrel protector 54 may include at least one shield and/or other structural element which may be attached to the securable strap segment 41 according to the knowledge of those skilled in the art.

Referring next to FIGS. 2-11 of the drawings, in some applications, the firearm harness 1 may be attached to a sling-less firearm 60 and donned by the firearm user 70, as illustrated in FIGS. 6-11, to enable the firearm user 70 to safely and securely carry the firearm 60 in a hands-free manner on even or uneven, forested or unforested ground or up a ladder leading to a deer stand or hunting blind, for example. Accordingly, the rear securing assembly 10 of the firearm harness 1 may initially be fastened to the firearm stock 61 of the firearm 60. To this end, the rear securing assembly 10 may initially be unfastened, as illustrated in FIG. 3, typically by deforming and clearing the rear securing buckle tabs 18 from the respective tab release openings 22 in the rear securing buckle receptacle 20 of the releasable rear securing strap connector 16 and pulling and releasing the rear securing buckle tabs 18 from the rear securing buckle receptacle 20, as illustrated in FIG. 3. The rear securing strap segment 1 may then be extended around the firearm stock 61 and the releasable rear securing strap connector 16 refastened, as illustrated in FIG. 2.

With the rear securing assembly 10 typically positioned behind the hip 73 of the firearm user 70, the main strap segment 3 of the harness strap 2 may extend up under the arm 75, diagonally across the chest 71 and then rearwardly over the opposite shoulder 74 of the firearm user 70. The front securing assembly 36 may be fastened to the firearm barrel 62 of the firearm 60. Accordingly, as illustrated in FIG. 7, the firearm 60 may extend diagonally across the back 72 of the firearm user 70 with the firearm barrel 62 typically aimed upwardly in an unobstructed manner as the firearm user 70 carries the firearm 60 hands-free to a selected destination or site for use. The firearm harness 1 may thusly secure the firearm 60 to the firearm user 70 to enable the firearm user 70 to safely and securely carry the firearm 60 on even or uneven, forested or unforested ground or up a ladder leading to a deer stand or hunting blind, for example, while enabling the firearm user 70 to carry other items and/or grasp the rungs of the ladder.

It will be appreciated by those skilled in the art that the firearm barrel 62 of the firearm 60 may safely remain in an upwardly-aimed orientation to maintain safety to both the firearm user 70 and other persons in the area. Prior to or during deployment, adjustments to the length of the firearm harness 1 may be made, as necessary, typically by sliding the main strap segment 3 of the harness strap 2 through the strap adjusting mechanism 44 (FIGS. 4 and 5) at the main strap segment loop 5.

Upon arrival of the firearm user 70 at the destination at which the firearm 60 is to be used, the front securing assembly 36 may be detached from the firearm barrel 62 of the firearm 60 typically by unfastening the releasable front securing strap connector 46, typically as was heretofore described with respect to FIG. 5. The rear securing assembly 10 may in like manner be detached from the firearm stock 61 typically by unfastening the releasable rear securing strap connector 16, typically as was heretofore described with respect to FIG. 3. After use of the firearm 60, the firearm harness 1 may again be deployed to secure the firearm 60 on the firearm user 70 to facilitate safe, secure and hands-free carrying and transport of the firearm 60.

Figure 12:
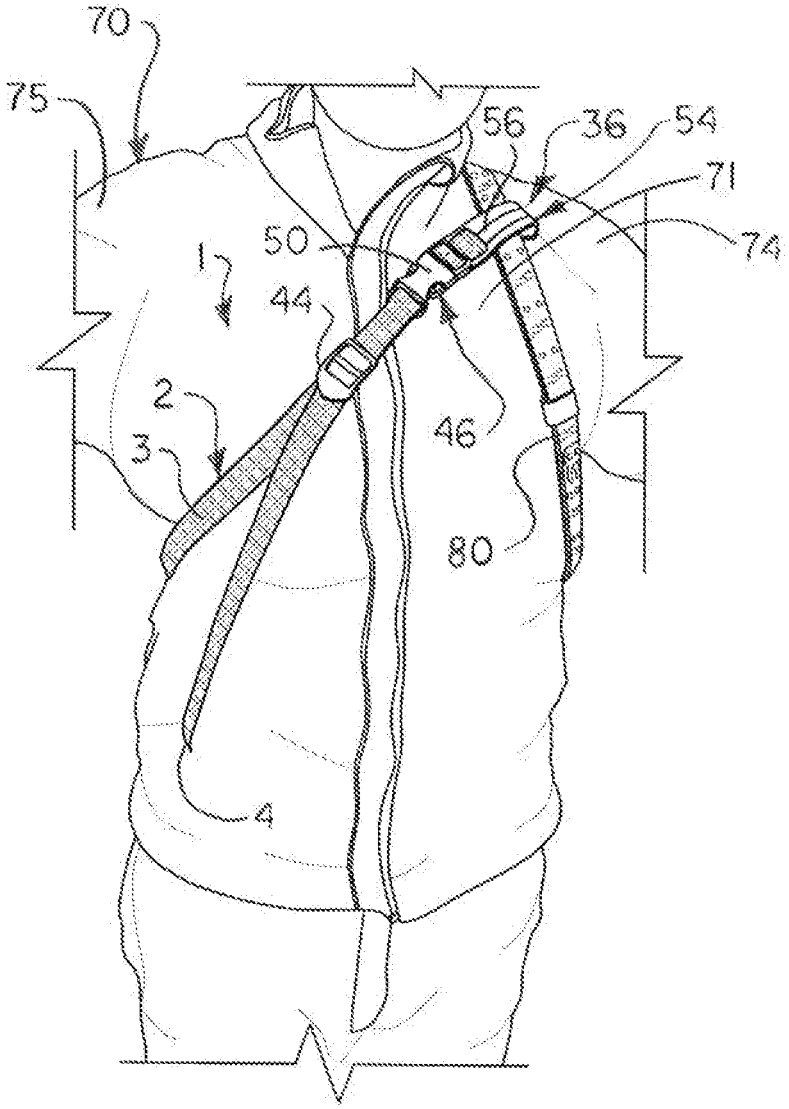
FIG. 12 is a front view of a firearm user with the illustrative firearm harness deployed in place on the firearm user and securing a firearm with a sling behind the user in some applications of the firearm harnesses, more particularly illustrating the front securing assembly of the firearm harness fastened to the firearm sling.
Figure 13:
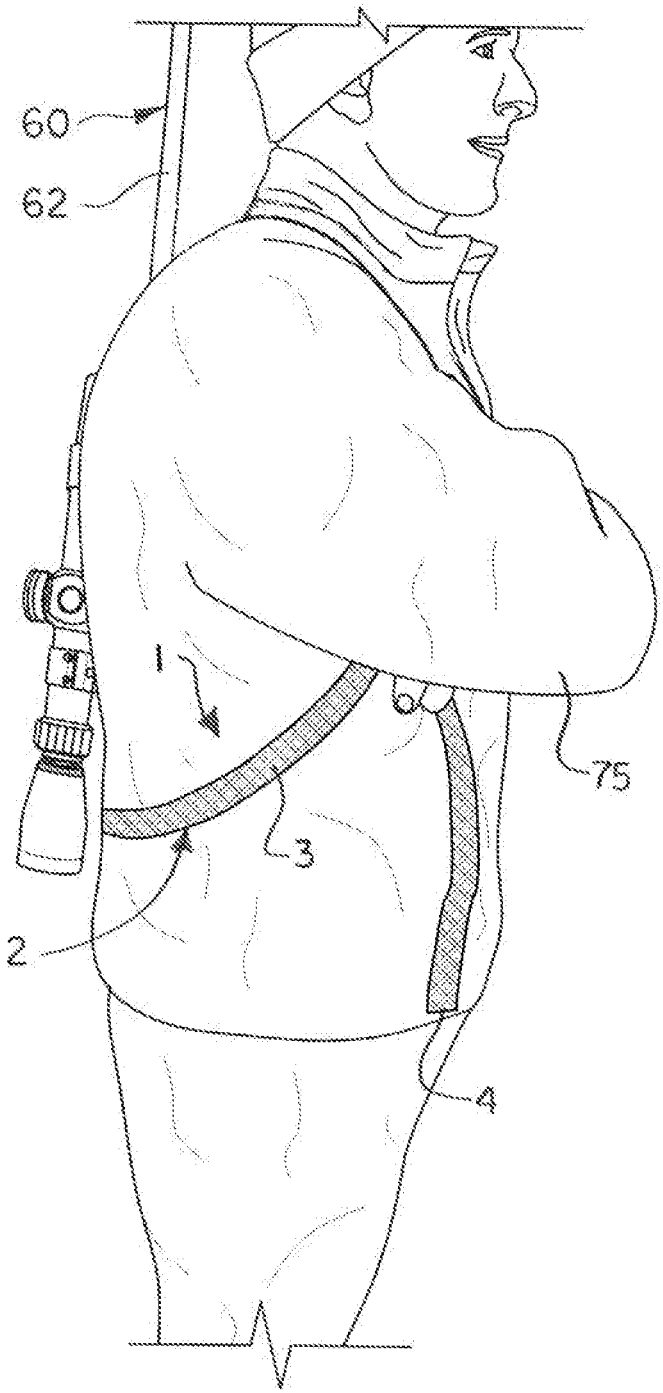
FIG. 13 is a right-side view of the firearm user with the firearm harness securing the slinged firearm to the user.

Referring next to FIGS. 12-15 of the drawings, in some applications, the firearm 60 may be fitted with a firearm sling 80. The firearm sling 80 may have a conventional design and may have a first end (not illustrated) attached to the firearm stock 61 and a second end (not illustrated) attached to the firearm barrel 62 or body of the firearm 60. Accordingly, the firearm sling 80 may extend over the shoulder 74 of the firearm user 70. As illustrated in FIG. 14, the rear securing assembly 10 of the firearm harness 1 may be fastened at one end to the firearm stock 61 of the firearm 60. The main strap segment 3 of the harness strap 2 may extend across the back 72 and under the arm 75 and diagonally upwardly across the chest 71 of the firearm user 70. The front securing assembly 36 may be fastened to the firearm sling 80 in front of the firearm user's shoulder 74, as illustrated in FIG. 12. Accordingly, as illustrated in FIGS. 14 and 15, the firearm 60 may extend vertically upwardly behind the hip 73 at the side of the firearm user 70 with the firearm barrel 62 typically aimed upwardly in an unobstructed manner as the firearm user 70 carries the firearm 60 to the selected destination or site for use and the hands of the firearm user 70 remain free. As illustrated in FIG. 12, the firearm harness 1 may pull the firearm sling 80 toward the midline of the chest 71 of the firearm user 70 to prevent the firearm sling 80 from slipping off the firearm user's shoulder 74.

It will be appreciated by those skilled in the art that the firearm harnesses 1 may be fabricated with a simple design using materials and fabrication methods known by those skilled in the art. In some embodiments, the main strap segment 3 of the harness strap 2 may be fabricated as a continuous strip of nylon, fabric, webbing and/or other flexible yet durable material or materials from the front main strap segment end 4 to the rear main strap segment end 13. The front securing strap 37 of the front securing assembly 36 may be fabricated of the same or different materials. The releasable rear securing strap connector 16 of the rear securing assembly 10 and the releasable front securing strap connector 46 of the front securing assembly 36 may include quick disconnect connectors, hook and loop fasteners, buckles, brackets, clips and clamps or combinations thereof. It will be further appreciated by those skilled in the art that the firearm harnesses 1 are amenable to other uses including but not limited to carrying and/or securing other items.

While illustrative embodiments of the disclosure have been described above, it will be recognized and understood that various modifications can be made and the appended claims are intended to cover all such modifications which may fall within the spirit and scope of the disclosure.

What is claimed is:

1. A firearm harness suitable for securing a firearm to a firearm user, comprising:

a harness strap including a main strap segment;

a rear securing assembly on the main strap segment, the rear securing assembly including:

a rear securing strap segment extending from the main strap segment of the harness strap;

a rear main strap segment end terminating the rear securing strap segment;

a rear securing strap loop formed in the rear main strap segment end of the rear securing strap segment; and a releasable rear securing strap connector releasably connecting the rear securing strap loop of the rear securing strap segment to the main strap segment of the harness strap, the releasable rear securing strap connector including:

a rear securing strap slider engaging the main strap segment of the harness strap at the rear securing strap segment, the rear securing strap slider defining a sliding boundary between the main strap segment and the rear securing strap segment of the harness strap;

a plurality of rear securing buckle tabs extending from the rear securing strap slider, and a rear securing buckle receptacle carried by the rear securing strap loop in the rear main strap segment end of the rear securing strap segment, the rear securing buckle receptacle configured to releasably receive the plurality of rear securing buckle tabs;

a strap adjusting connector on the main strap segment, the main strap segment having a main strap segment loop engaging the strap adjusting connector; and a front securing assembly on the main strap segment of the harness strap in spaced-apart relationship to the rear securing assembly and adjacent to the strap adjusting connector, the front securing assembly including:

a front securing strap having:

a connecting strap segment;

a proximal strap loop formed in the connecting strap segment, the proximal strap loop engaging the strap adjusting connector on the main strap segment of the harness strap;

a distal strap loop formed in the connecting strap segment opposite the proximal strap loop;

a securable strap segment branching from the connecting strap segment adjacent to the distal strap loop; and a releasable front securing strap connector releasably securing the securable strap segment of the front securing strap between fastened and unfastened configurations, the releasable front securing strap connector including:

a front securing strap slider terminating the securable strap segment of the front securing strap;

a plurality of front securing buckle tabs extending from the front securing strap slider; and a font securing buckle receptacle carried by the distal strap loop in the connecting strap segment of the front securing strap, the front securing buckle receptacle configured to releasably receive the plurality of front securing buckle tabs.

2. The firearm harness of claim 1 further comprising at least one stock protector including at least one elongated, flexible stock protecting shield on the rear securing strap segment of the rear securing assembly.

3. The firearm harness of claim 2 further comprising at least one pair of strap slits in the stock protecting shield, and wherein the rear securing strap segment extends through the strap slits.

4. The firearm harness of claim 1 further comprising at least one barrel protector on the securable strap segment of the front securing strap of the front securing assembly.

* * * * *